US012553449B1

(12) United States Patent
Chen

(10) Patent No.: US 12,553,449 B1
(45) Date of Patent: Feb. 17, 2026

(54) FAN BLADE INSTALLATION STRUCTURE WITH MULTIPLE SAFETY MECHANISMS

(71) Applicant: AIR COOL INDUSTRIAL CO., LTD., Taichung (TW)

(72) Inventor: Ken-Tuan Chen, Taichung (TW)

(73) Assignee: AIR COOL INDUSTRIAL CO., LTD., Taichung (TW)

( * ) Notice: Subject to any disclaimer, the term of this patent is extended or adjusted under 35 U.S.C. 154(b) by 0 days.

(21) Appl. No.: 19/235,612

(22) Filed: Jun. 12, 2025

(51) Int. Cl.

| | |
|---|---|
| ***F04D 29/34*** | (2006.01) |
| ***F04D 19/00*** | (2006.01) |
| ***F04D 25/08*** | (2006.01) |
| ***F04D 29/64*** | (2006.01) |

(52) U.S. Cl.
CPC ..... *F04D 29/34* (2013.01); *F04D 19/002* (2013.01); *F04D 25/088* (2013.01); *F04D 29/646* (2013.01)

(58) Field of Classification Search
CPC ..... F04D 29/34; F04D 19/002; F04D 25/088; F04D 29/646
See application file for complete search history.

(56) References Cited

U.S. PATENT DOCUMENTS

| | | | | |
|---|---|---|---|---|
| 6,309,183 | B1 * | 10/2001 | Bucher | F04D 29/34 416/207 |
| 8,092,184 | B2 * | 1/2012 | Wang | F04D 25/088 416/220 R |
| 8,197,216 | B2 * | 6/2012 | Wang | F04D 29/646 416/210 R |
| 12,180,973 | B1 * | 12/2024 | Chen | F04D 25/088 |
| 2005/0123403 | A1 * | 6/2005 | Tai | F04D 29/34 416/210 R |
| 2010/0284813 | A1 * | 11/2010 | Wang | F04D 25/088 416/206 |
| 2015/0078903 | A1 * | 3/2015 | Lowe | F04D 29/644 29/889.3 |
| 2017/0037869 | A1 * | 2/2017 | Zauhar | F04D 25/088 |
| 2017/0350414 | A1 * | 12/2017 | Wang | F04D 25/088 |
| 2019/0145424 | A1 * | 5/2019 | Tai | F04D 29/388 416/220 A |
| 2023/0111026 | A1 * | 4/2023 | Wang | F04D 29/34 416/210 R |

* cited by examiner

*Primary Examiner* — Andrew J Marien
(74) *Attorney, Agent, or Firm* — Che-Yang Chen

(57) ABSTRACT

A fan blade installation structure with multiple safety mechanisms includes a blade holder, a rotating member, and a snap member. The rotating member is pivotally connected to the blade holder through an elastic member. A blade can be inserted and secured to the blade holder through the rotating member. The outside of the blade holder has a guide rail. The snap member is slidably connected to the guide rail for the snap member to snap the rotating member. When the user assembles and disassembles the blade, no tools are required, and the multiple safety mechanisms enhance the convenience and safety during assembly and disassembly.

6 Claims, 10 Drawing Sheets

FAN BLADE INSTALLATION STRUCTURE WITH MULTIPLE SAFETY MECHANISMS

FIELD OF THE INVENTION

The present invention relates to a ceiling fan, and more particularly to a fan blade installation structure with multiple safety mechanisms.

BACKGROUND OF THE INVENTION

In general, a conventional fan blade installation structure is applied to a ceiling fan device. The fan blade installation structure includes a slot for the end of a blade to be inserted into the slot. The blade has a positioning hole. A groove is formed in the slot. An elastic fastener is disposed in the groove. The elastic fastener is normally located in the slot. When the end of the blade pushes the elastic fastener, the elastic fastener is displaced to the groove and moved away from the slot, thereby allowing the end of the blade to be fully inserted into the slot. When the positioning hole of the blade is aligned with the elastic fastener, the elastic fastener is elastically displaced and engaged in the positioning hole of the blade, so as to secure the blade quickly.

Due to long-term use of the ceiling fan, the elastic fastener may experience fatigue, aging or damage, resulting in that the elastic fastener is unable to secure the blade well. This may cause the blade to come loose, which may be dangerous to use. Accordingly, the inventor of the present invention has devoted himself based on his many years of practical experiences to solve these problems.

SUMMARY OF THE INVENTION

The primary object of the present invention is to provide a fan blade installation structure with multiple safety mechanisms, which does not require the use of tools and has multiple safety mechanisms to enhance the convenience and safety during assembly and disassembly.

In order to achieve the above object, the present invention provides a fan blade installation structure with multiple safety mechanisms, applied to a blade. One end of the blade has a first connecting portion. The first connecting portion has a blade hole longitudinally passing through the first connecting portion. The fan blade installation structure comprises a blade holder, a rotating member, and a snap member. The blade holder is fixedly connected to a rotating unit of a ceiling fan. The blade holder has a slot. The slot forms a slot space therein. The slot has a first opening for insertion of the first connecting portion of the blade so that the blade can be moved along a displacement path within the slot space. The slot of the blade holder has a second opening corresponding to the blade hole. An outer side of the blade holder has a guide rail and a second connecting portion. One end of the guide rail, adjacent to the second opening, is defined as a snap end. The rotating member is pivotally connected to the blade holder. The rotating member has a third connecting portion corresponding to the second connecting portion. The third connecting portion is connected to the second connection portion through an elastic member. One side of the rotating member, facing away from the slot space, has a first snap portion and a first force-applying portion. The first snap portion and the first force-applying portion are located outside the slot. Another side of the rotating member, facing the slot space, has a protrusion corresponding to the second opening of the blade holder and the blade hole of the blade. The protrusion has a first pushing surface corresponding to the first opening and the first connecting portion of the blade. The snap member is slidably connected to the guide rail. The snap member has a closed end. The closed end of the snap member is connected to an elastic arm. The elastic arm has a second force-applying portion. The second force-applying portion has a second pushing surface corresponding to the first snap portion for the first snap portion and a user to push against the second pushing surface. The elastic arm has a second snap portion corresponding to the first snap portion. The second snap portion is located between the closed end and the second force-applying portion. When the snap member is away from the snap end of the guide rail and the elastic member is in a normal state, the elastic member leans against the rotating member, such that the rotating member passes through the second opening, and the protrusion and the first pushing surface of the rotating member are in the displacement path for the first connecting portion of the blade to push against the first pushing surface. When the snap member is away from the snap end of the guide rail and the first connecting portion of the blade pushes against the first pushing surface of the protrusion of the rotating member, the rotating member applies force to the elastic member, such that the protrusion of the rotating member is moved away from the displacement path via the second opening, allowing the first connecting portion of the blade to pass through and be fully inserted into the slot space, when the blade hole of the blade is aligned with the protrusion of the rotating member, the elastic member applies force to the rotating member, such that the protrusion passes through the second opening and is engaged with the blade hole of the blade, thereby forming a first safety mechanism. When the blade, the blade holder and the rotating member are assembled, the elastic member is in the normal state, the first snap portion of the rotating member is located outside the blade holder, and the second pushing surface of the snap member applies force to the first snap portion, such that the second force-applying portion is displaced, and the elastic arm and the second snap portion are elastically deformed, allowing the snap member to be displaced to the snap end of the guide rail and enabling the second snap portion of the snap member to snap onto the first snap portion to confine the rotating member, thereby forming a second safety mechanism. When the second safety mechanism is to be released, the user applies force to the second force-applying portion to displace the second force-applying portion, such that the elastic arm and the second snap portion are elastically deformed to disengage the snap member from the first snap portion, thereby allowing the snap member to move away from the first snap portion. When the second safety mechanism has been released and the first safety mechanism is to be released, the user applies force to the first force-applying portion of the rotating member, such that the rotating member applies force to the elastic member, and the protrusion of the rotating member is moved away from the displacement path and the blade hole via the second opening, thereby allowing the blade to be removed from the slot space.

When the user assembles the blades of the ceiling fan on the ceiling using the fan blade installation structure with multiple safety mechanisms, no tools are required and the multiple safety mechanisms enhance the convenience and safety during assembly and disassembly.

DETAILED DESCRIPTION OF THE PREFERRED EMBODIMENTS

Figure 1:
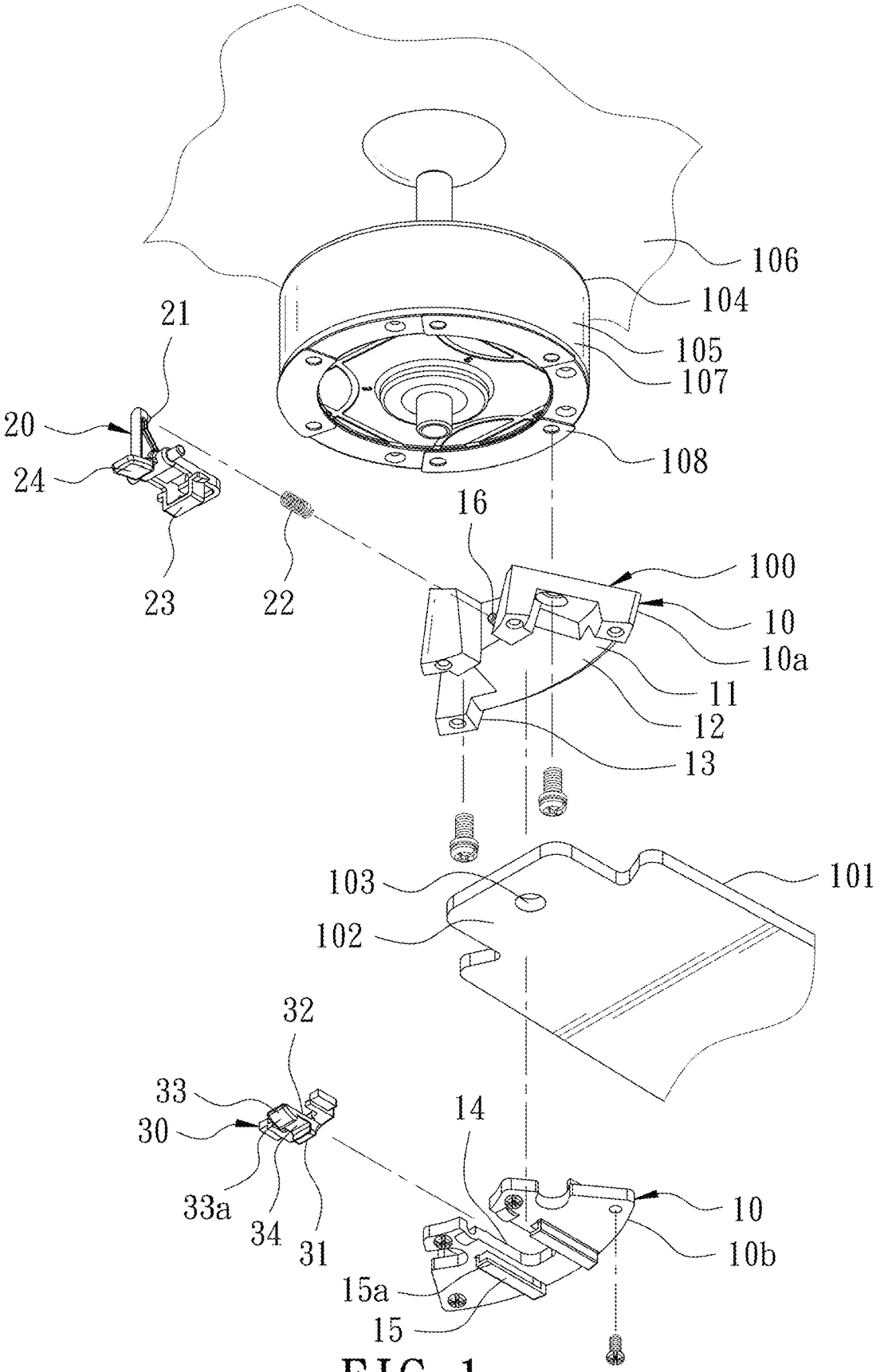
FIG. 1 is an exploded view according to a preferred embodiment of the present invention.
Figure 2:
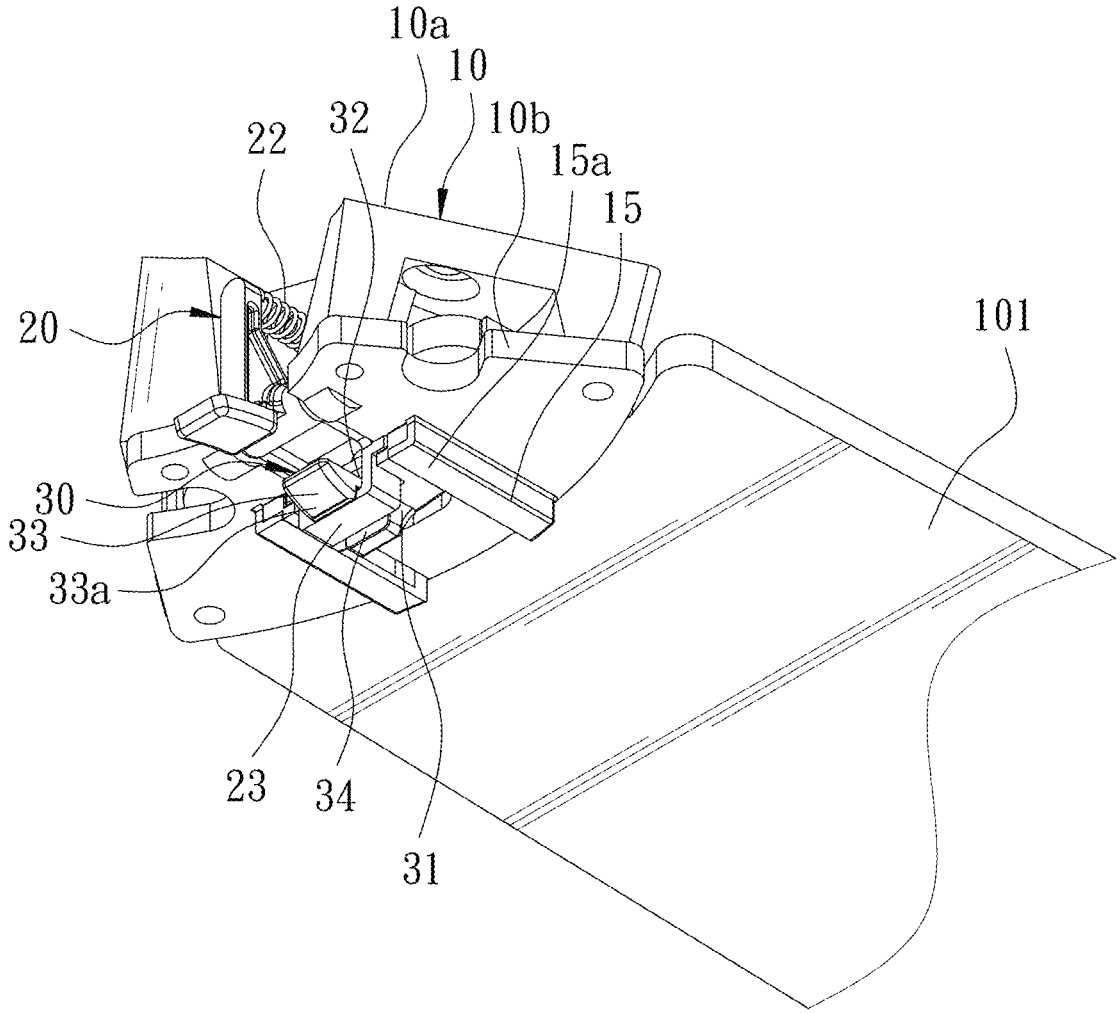
FIG. 2 is a perspective view according to the preferred embodiment of the present invention when in use, illustrating that the blade is assembled to the blade bracket.

Embodiments of the present invention will now be described, by way of example only, with reference to the accompanying drawings.

As shown in FIG. 1 through FIG. 10, the present invention discloses a fan blade installation structure 100 with multiple safety mechanisms, which can be applied to a blade 101. One end of the blade 101 has a first connecting portion 102. The first connecting portion 102 has a blade hole 103 longitudinally passing through the first connecting portion 102. The fan blade installation structure 100 comprises a blade holder 10, a rotating member 20, and a snap member 30.

The blade holder 10 can be fixedly connected to a rotating unit 105 of a ceiling fan 104. The ceiling fan 104 is fixed to a ceiling 106 and includes the rotating unit 105. The rotating unit 105 has a motor 107 and at least one rotating bracket 108. The at least one rotating bracket 108 is connected to the motor 107. The motor 107 drives the at least one rotating bracket 108 to rotate. The motor 101 is an external rotor motor. The blade holder 10 is formed with a slot 11 and two pivoting portions. The slot 11 forms a slot space 12 therein. The slot 11 has a first opening 13 for insertion of the first connecting portion 102 of the blade 101, so that the blade 101 can be moved along a displacement path P within the slot space 12. The slot 11 of the blade holder 10 has a second opening 14 corresponding to the blade hole 103. The outer side of the blade holder 10 has a guide rail 15 and a second connecting portion 16. The guide rail 15 is located adjacent to the second opening 14. One end of the guide rail 15, adjacent to the second opening 14, is defined as a snap end 15*a*. The blade holder 10 includes a first seat 10*a* and a second seat 10*b*. The first seat 10*a* is fixedly connected to the second seat 10*b* to form the slot 11 between the first seat 10*a* and the second seat 10*b*. The first opening 13 and the second opening 14 are formed in at least one of the first seat 10*a* and the second seat 10*b*.

The rotating member 20 has a rotating shaft. The rotating member 20 is pivotally connected to the pivoting portion of the blade holder 10 through the rotating shaft. The rotating member 20 has a third connecting portion 21 corresponding to the second connecting portion 16. The third connecting portion 21 is connected to the second connection portion 16 through an elastic member 22. One side of the rotating member 20, facing away from the slot space 12, has a first snap portion 23 and a first force-applying portion 24. The first snap portion 23 and the first force-applying portion 24 are located outside the slot 11. The first snap portion 23 corresponds to the snap end 15*a* of the guide rail 15. Another side of the rotating member 20, facing the slot space 12, has a protrusion 25 corresponding to the second opening 14 of the blade holder 10 and the blade hole 103 of the blade 101. The protrusion 25 has a first pushing surface 25*a* corresponding to the first opening 13 and the first connecting portion 102 of the blade 101. The third connecting portion 21, the first snap portion 23, the first force-applying portion 24 and the protrusion 25 of the rotating member 20 are integrally formed. The third connecting portion 21, the first snap portion 23, the first force-applying portion 24 and the protrusion 25 are moved synchronously in the pivoting direction of the rotating member 20.

The snap member 30 is slidably connected to the guide rail 15. The snap member 30 can be displaced along the guide rail 15. The snap member 30 has a closed end 31. The closed end 31 of the snap member 30 is connected to an elastic arm 32. The elastic arm 32 has a second force-applying portion 33. The second force-applying portion 33 has a second pushing surface 33*a* corresponding to the first snap portion 23 for the first snap portion 23 and the user to push against the second pushing surface 33*a*. The elastic arm 32 has a second snap portion 34 corresponding to the first snap portion 23. The second snap portion 34 is located between the closed end 31 and the second force-applying portion 33. The second pushing surface 33*a* is oriented in a direction away from the closed end 31. The second pushing surface 33*a* is a curved surface. The second pushing surface 33*a* extends in a direction away from the closed end 31 toward the second opening 14. The closed end 31, the elastic arm 32, the second force-applying portion 33 and the second snap portion 34 of the snap member 30 are integrally formed.

Figure 3:
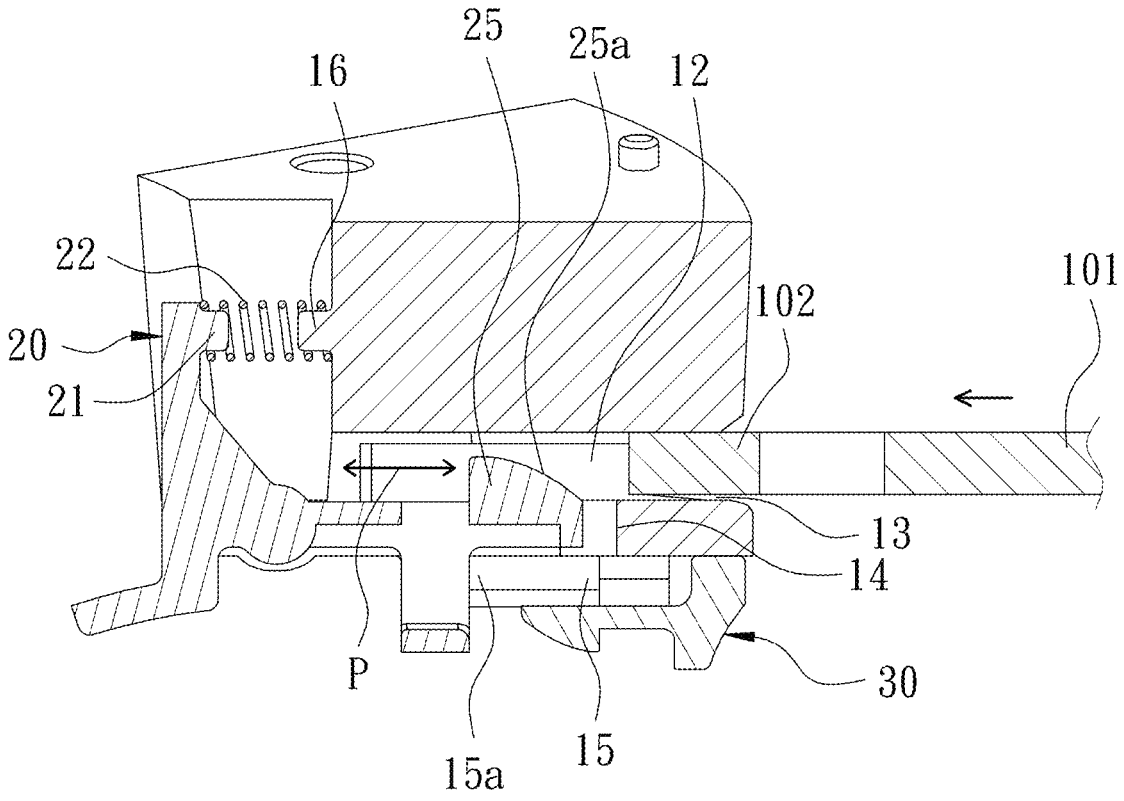
FIG. 3 is a cross-sectional view according to the preferred embodiment of the present invention when in use, illustrating that the end of the blade is inserted into the slot.

Referring to FIG. 3, when the snap member 30 is away from the snap end 15*a* of the guide rail 15 and the elastic member 22 is in a normal state, the elastic member 22 leans against the rotating member 20, such that the rotating member 20 passes through the second opening 14, and the protrusion 25 and the first pushing surface 25*a* of the rotating member 20 are in the displacement path P and the slot space 12. The first pushing surface 25*a* is oriented toward the first opening 13. The first pushing surface 25*a* is a curved surface. The first pushing surface 25*a* extends in a direction away from the first opening 13 and the second opening 14 for the first connecting portion 102 of the blade 101 to push against the first pushing surface 25*a*.

Figure 4:
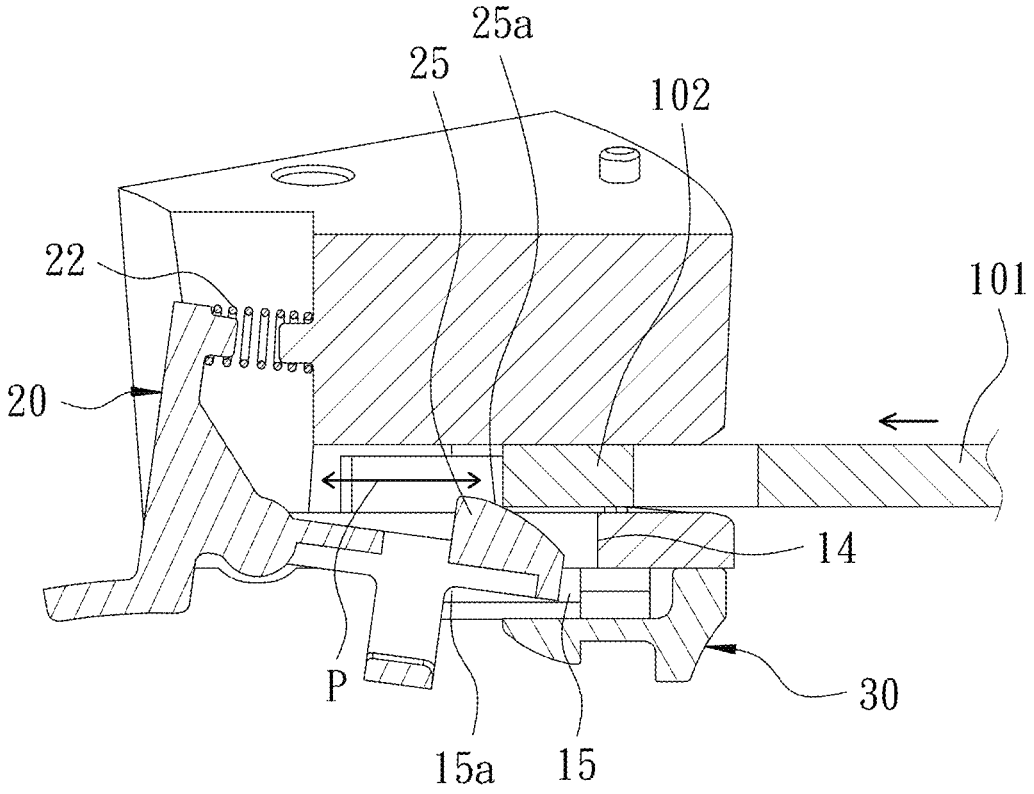
FIG. 4 is a cross-sectional view according to the preferred embodiment of the present invention when in use, illustrating that the end of the blade is pushed against the rotating member.
Figure 5:
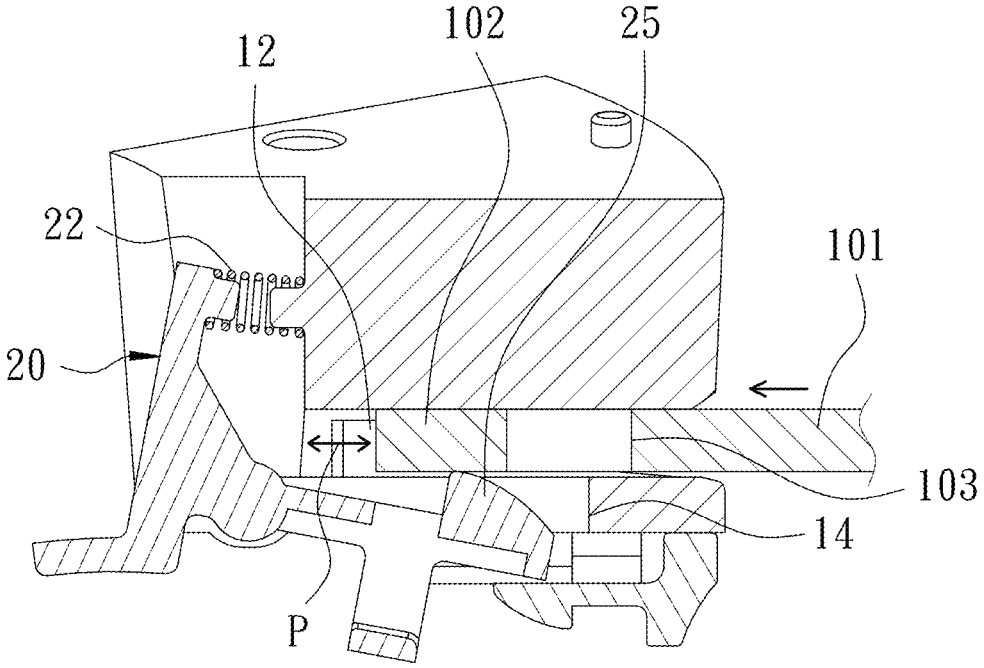
FIG. 5 is a cross-sectional view according to the preferred embodiment of the present invention when in use, illustrating that the rotating member is moved away from the displacement path.
Figure 6:
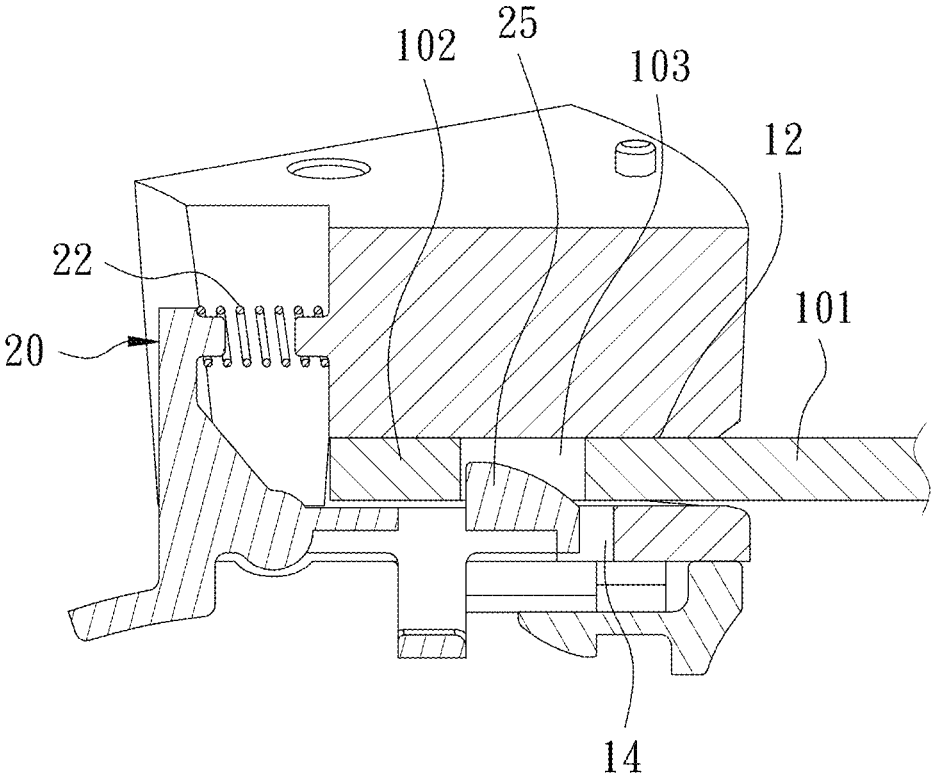
FIG. 6 is a cross-sectional view according to the preferred embodiment of the present invention when in use, illustrating the first safety mechanism.

Referring to FIG. 4, when the snap member 30 is away from the snap end 15*a* of the guide rail 15 and the first connecting portion 102 of the blade 101 pushes against the first pushing surface 25*a* of the protrusion 25 of the rotating member 20, the rotating member 20 applies force to the elastic member 22, such that the protrusion 25 of the rotating member 20 is moved away from the displacement path P via the second opening 14, as shown in FIG. 5, allowing the first connecting portion 102 of the blade 101 to pass through and be fully inserted into the slot space 12. When the blade hole 103 of the blade 101 is aligned with the protrusion 25 of the rotating member 20, the elastic member 22 applies force to the rotating member 20 through its elastic force, causing the rotating member 20 to rotate, such that the protrusion 25 passes through the second opening 14 and is engaged with the blade hole 103 of the blade 101, thereby forming a first safety mechanism, as shown in FIG. 6.

Figure 7:
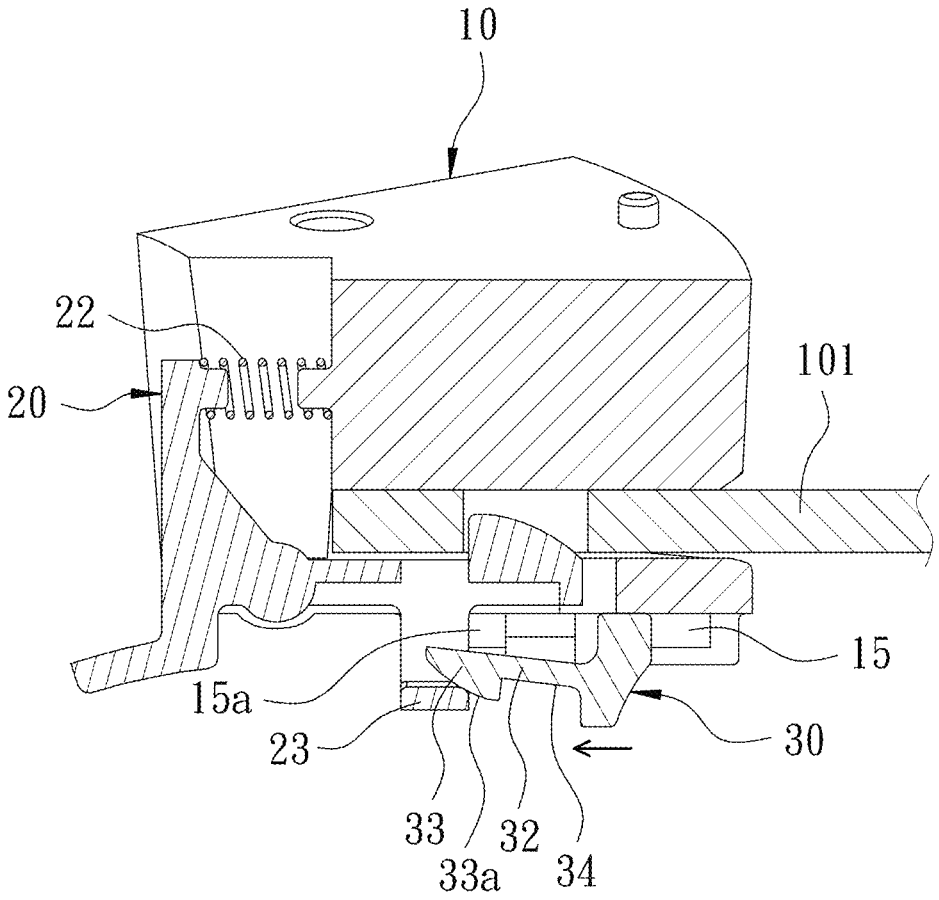
FIG. 7 is a cross-sectional view according to the preferred embodiment of the present invention when in use, illustrating that the snap member is pushed against the rotating member.
Figure 8:
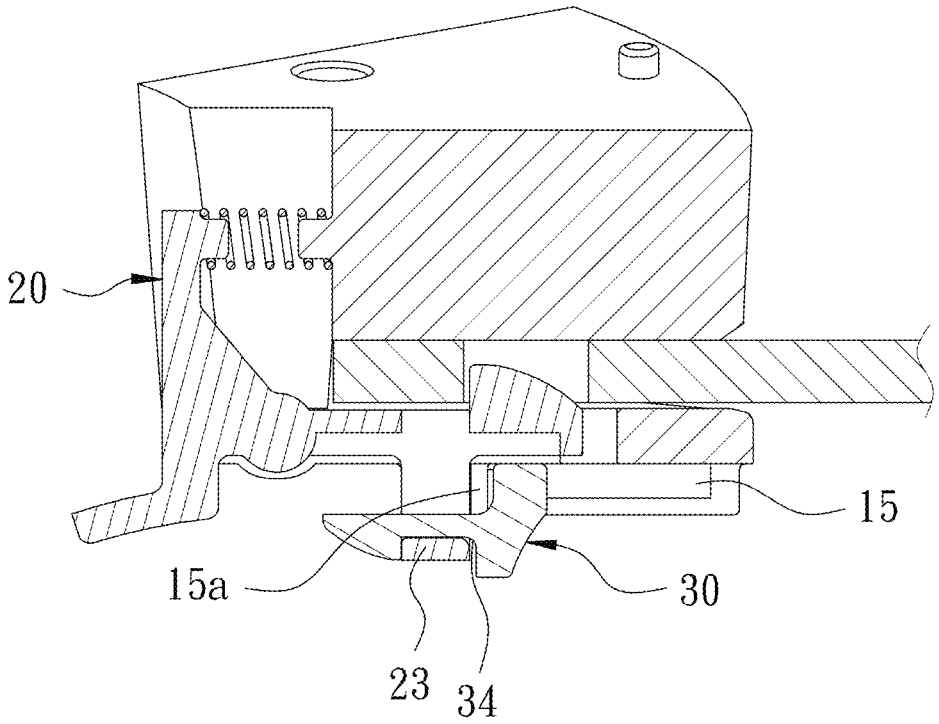
FIG. 8 is a cross-sectional view according to the preferred embodiment of the present invention when in use, illustrating the second safety mechanism.

When the blade 101, the blade holder 10 and the rotating member 20 are assembled, the elastic member 22 is in the normal state, the first snap portion 23 of the rotating member 20 is located outside the blade holder 10, and the second pushing surface 33*a* of the snap member 30 applies force to the first snap portion 23, as shown in FIG. 7, such that the second force-applying portion 33 is displaced, and the elastic arm 32 and the second snap portion 34 are elastically deformed. The elastic displacement direction of the second force-applying portion 33 is different from the displacement direction of the snap member 30 on the guide rail 15, thereby allowing the snap member 30 to be displaced to the snap end 15*a* of the guide rail 15 and allowing the second pushing surface 33*a* to move along the periphery of the first snap portion 23 so that the second snap portion 34 is displaced to the position of the first snap portion 23. Thus, the second snap portion 34 of the snap member 30 snaps onto the first snap portion 23 to confine the rotating member 20, thereby forming a second safety mechanism, as shown in FIG. 8.

Figure 9:
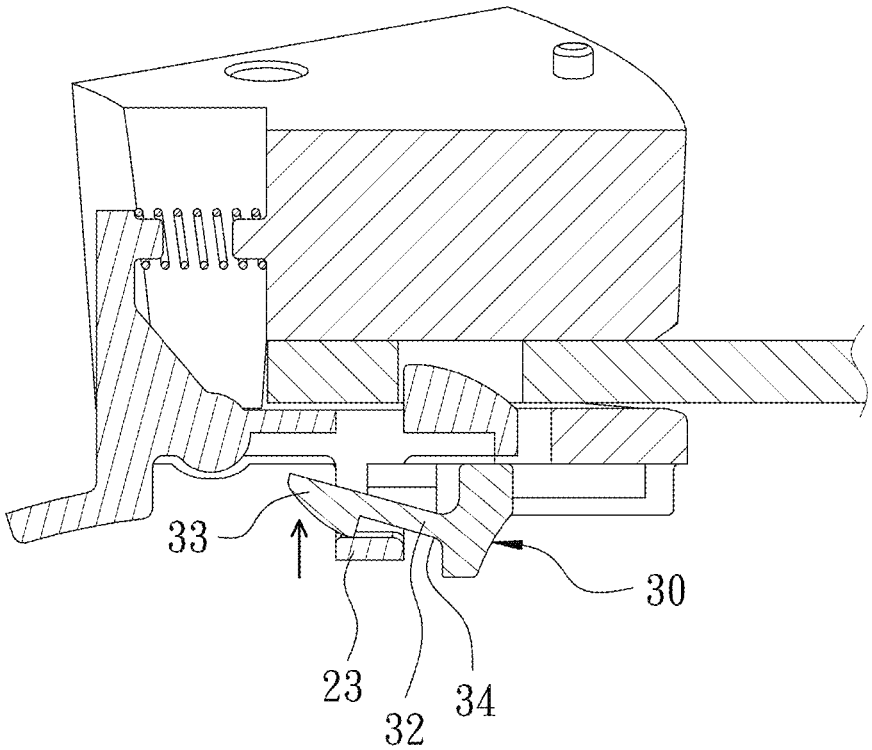
FIG. 9 is a cross-sectional view according to the preferred embodiment of the present invention when in use, illustrating that the second safety mechanism is released.

Referring to FIG. 9, when the second safety mechanism is to be released, the user can apply force to the second force-applying portion 33 to displace the second force-applying portion 33, such that the elastic arm 32 and the second snap portion 34 are elastically deformed to disengage the snap member 30 from the first snap portion 23, thereby allowing the snap member 30 to move away from the first snap portion 23.

Figure 10:
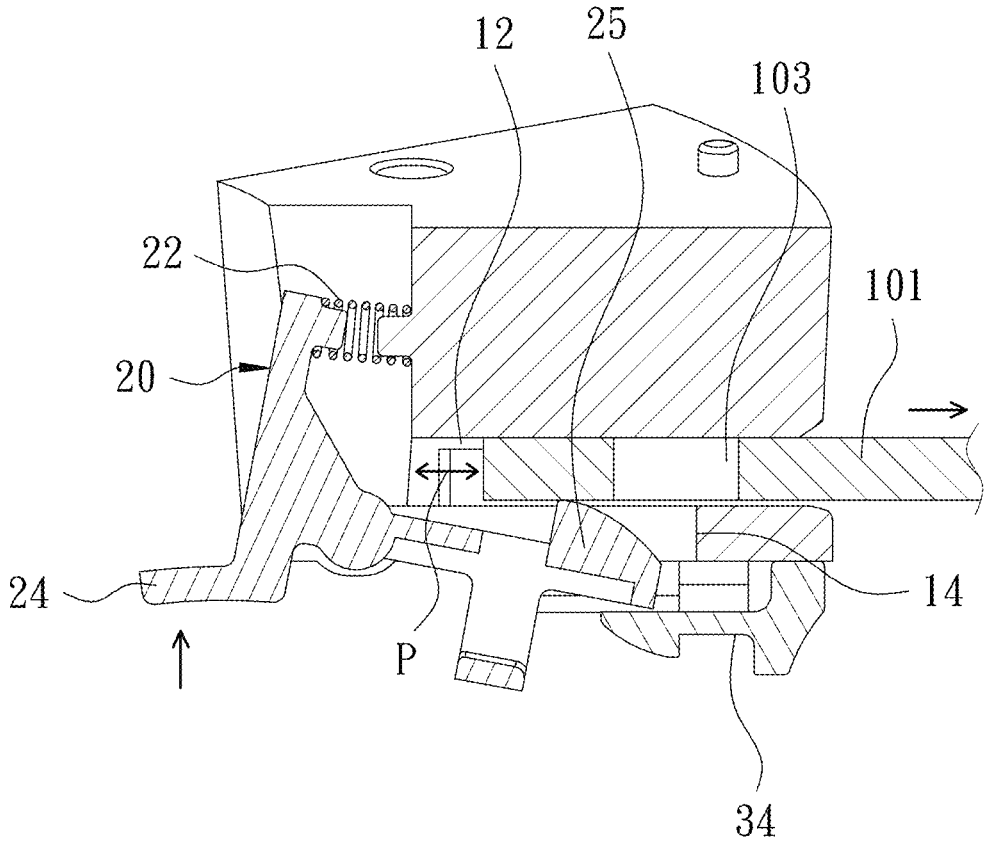
FIG. 10 is a cross-sectional view according to the preferred embodiment of the present invention when in use, illustrating that the first safety mechanism is released.

Referring to FIG. 10, when the second safety mechanism has been released and the first safety mechanism is to be released, the user can apply force to the first force-applying portion 24 of the rotating member 20, such that the rotating member 20 applies force to the elastic member 22, and the protrusion 25 of the rotating member 20 is moved away from the displacement path P and the blade hole 103 via the second opening 14, thereby allowing the blade 101 to be removed from the slot space 12.

Thus, when the user assembles the blade 101 of the ceiling fan 104 on the ceiling 106 using the fan blade installation structure 100 with multiple safety mechanisms, no tools are required and the multiple safety mechanisms enhance the convenience and safety during assembly and disassembly.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A fan blade installation structure with multiple safety mechanisms, applied to a blade, one end of the blade having a first connecting portion, the first connecting portion having a blade hole longitudinally passing through the first connecting portion, the fan blade installation structure comprising:

a blade holder, fixedly connected to a rotating unit of a ceiling fan, the blade holder having a slot, the slot forming a slot space therein, the slot having a first opening for insertion of the first connecting portion of the blade so that the blade can be moved along a displacement path within the slot space, the slot of the blade holder having a second opening corresponding to the blade hole, an outer side of the blade holder having a guide rail and a second connecting portion, one end of the guide rail, adjacent to the second opening, being defined as a snap end;

a rotating member, pivotally connected to the blade holder, the rotating member having a third connecting portion corresponding to the second connecting portion, the third connecting portion being connected to the second connection portion through an elastic member, one side of the rotating member, facing away from the slot space, having a first snap portion and a first force-applying portion, the first snap portion and the first force-applying portion being located outside the slot, another side of the rotating member, facing the slot space, having a protrusion corresponding to the second opening of the blade holder and the blade hole of the blade, the protrusion having a first pushing surface corresponding to the first opening and the first connecting portion of the blade;

a snap member, slidably connected to the guide rail, the snap member having a closed end, the closed end of the snap member being connected to an elastic arm, the elastic arm having a second force-applying portion, the second force-applying portion having a second pushing surface corresponding to the first snap portion for the first snap portion and a user to push against the second pushing surface, the elastic arm having a second snap portion corresponding to the first snap portion, the second snap portion being located between the closed end and the second force-applying portion;

wherein when the snap member is away from the snap end of the guide rail and the elastic member is in a normal state, the elastic member leans against the rotating member, such that the rotating member passes through the second opening, and the protrusion and the first pushing surface of the rotating member are in the displacement path for the first connecting portion of the blade to push against the first pushing surface;

wherein when the snap member is away from the snap end of the guide rail and the first connecting portion of the blade pushes against the first pushing surface of the protrusion of the rotating member, the rotating member applies force to the elastic member, such that the protrusion of the rotating member is moved away from the displacement path via the second opening, allowing the first connecting portion of the blade to pass through and be fully inserted into the slot space, when the blade hole of the blade is aligned with the protrusion of the rotating member, the elastic member applies force to the rotating member, such that the protrusion passes through the second opening and is engaged with the blade hole of the blade, thereby forming a first safety mechanism;

wherein when the blade, the blade holder and the rotating member are assembled, the elastic member is in the normal state, the first snap portion of the rotating member is located outside the blade holder, and the second pushing surface of the snap member applies force to the first snap portion, such that the second force-applying portion is displaced, and the elastic arm and the second snap portion are elastically deformed, allowing the snap member to be displaced to the snap end of the guide rail and enabling the second snap portion of the snap member to snap onto the first snap portion to confine the rotating member, thereby forming a second safety mechanism;

wherein when the second safety mechanism is to be released, the user applies force to the second force-applying portion to displace the second force-applying portion, such that the elastic arm and the second snap portion are elastically deformed to disengage the snap member from the first snap portion, thereby allowing the snap member to move away from the first snap portion;

wherein when the second safety mechanism has been released and the first safety mechanism is to be released, the user applies force to the first force-applying portion of the rotating member, such that the rotating member applies force to the elastic member, and the protrusion of the rotating member is moved away from the displacement path and the blade hole via the second opening, thereby allowing the blade to be removed from the slot space.

2. The fan blade installation structure as claimed in claim 1, wherein the first pushing surface is oriented toward the first opening, the first pushing surface is a curved surface, the first pushing surface extends in a direction away from the first opening and the second opening, the second pushing surface is oriented in a direction away from the closed end, the second pushing surface is a curved surface, and the second pushing surface extends away from the closed end.

3. The fan blade installation structure as claimed in claim 1, wherein the ceiling fan includes the rotating unit, the rotating unit has a motor and at least one rotating bracket, the at least one rotating bracket is connected to the motor, and the motor drives the at least one rotating bracket to rotate.

4. The fan blade installation structure as claimed in claim 1, wherein the blade holder includes a first seat and a second seat, the first seat is fixedly connected to the second seat to form the slot between the first seat and the second seat, and the first opening and the second opening are formed in at least one of the first seat and the second seat.

5. The fan blade installation structure as claimed in claim 1, wherein the third connecting portion, the first snap portion, the first force-applying portion and the protrusion of the rotating member are integrally formed, and the third connecting portion, the first snap portion, the first force-applying portion and the protrusion are moved synchronously in a pivoting direction of the rotating member.

6. The fan blade installation structure as claimed in claim 1, wherein the closed end, the elastic arm, the second force-applying portion and the second snap portion of the snap member are integrally formed.

* * * * *